US006147582A

United States Patent [19]

Goldsmith et al.

[11] Patent Number: 6,147,582

[45] Date of Patent: Nov. 14, 2000

[54] SUBSTRATE SUPPORTED THREE-DIMENSIONAL MICRO-COIL

[75] Inventors: Charles L. Goldsmith, Plano; Andrew Malczewski, Arlington; John C. Ehmke, Garland; Zhimin Yao, Dallas, all of Tex.

[73] Assignee: Raytheon Company, Lexington, Mass.

[21] Appl. No.: 09/262,786

[22] Filed: Mar. 4, 1999

[51] Int. Cl.[7] ..... H01F 5/00; H01F 27/28

[52] U.S. Cl. ..... 336/200; 336/233; 336/232

[58] Field of Search ..... 336/200, 232, 336/223

[56] References Cited

U.S. PATENT DOCUMENTS

| | | | |
|---|---|---|---|
| 5,425,167 | 6/1995 | Shiga et al. | 29/606 |
| 5,450,755 | 9/1995 | Saito et al. | 336/200 |
| 5,477,204 | 12/1995 | Li | 336/200 |

FOREIGN PATENT DOCUMENTS

| | | | |
|---|---|---|---|
| 3-263805 | 11/1991 | Japan | 336/200 |
| 6-36932 | 2/1994 | Japan | 336/200 |

OTHER PUBLICATIONS

Ahn et al, "A Fully Integrated Planar Toroidal Inductor with a Micromachined Nicke–Iron Magnetic Bar", IEEE Transaction on Components, packaging, and manufacturing Technology– Part A, vol. 17, No. 3, Sep. 1994.

Senda et al, "High frequency measurement technique for patterned soft magnetic film ppermeability with magnetic film/conductor/magnetic film inductance line", American Institute of Physics, pp. 1034–1037, Apr. 1993.

*Primary Examiner*—Michael L. Gellner
*Assistant Examiner*—Anh Mai
*Attorney, Agent, or Firm*—Baker Botts L.L.P.

[57] ABSTRACT

A method of forming a three-dimensional micro-coil on a substrate (10) is provided which consists of forming a first metal layer (14) on the substrate (10). The first metal layer (14) is partitioned into a first plurality of metal strips (16). A sacrificial layer (18) is formed on the first plurality of metal strips (16). A second metal layer (24) is formed on the sacrificial layer (18). The second metal layer (24) is then partitioned into a second plurality of metal strips (26) such that a continuous loop of metal is formed between the first plurality of metal strips (16) and the second plurality of metal strips (26). This continuous loop of metal defines windings for a three-dimensional micro-coil (28) with one side in contact with the substrate (10).

6 Claims, 3 Drawing Sheets

SUBSTRATE SUPPORTED THREE-DIMENSIONAL MICRO-COIL

TECHNICAL FIELD OF THE INVENTION

This invention relates in general to the field of micro-devices, and more particularly to an improved method and apparatus for constructing a three-dimensional micro-coil on a substrate.

BACKGROUND OF THE INVENTION

Electrical coils are often used as inductors and transformers in electrical circuit design. In integrated circuits, these coils are typically planar, existing in two dimensions only. These planar coils have several problems. The inductance per unit length is low and the signal loss is high. The parasitic capacitance, including inter-electrode and line-ground capacitance, is high causing low resonant frequency. In addition, planar coils of this type occupy a large amount of space on an integrated circuit. The low quality factor, evidenced by the low inductance per unit length and high signal loss, makes these planar coils a poor choice for on-chip filter design. Because of these problems, it is difficult, if not impossible, to make good on-chip filters using planar coils as inductors.

Planar coils also suffer from inefficient use of magnetic fields which are part of any electrical coil. In a planar coil, the magnetic fields of adjacent turns of the coil are in opposite directions. Therefore, there is no mutual inductance. There is only the self-inductance of each turn of the coil. The lack of mutual inductance manifests itself in low inductance per unit length. The high inter-electrode capacitance is caused by the fact that every adjacent turn in the planar coil is coupled by the substrate. In addition, the magnetic fields in a planar coil can be terminated by the ground beneath the integrated circuit substrate, thus causing induced currents which greatly increase loss of electrical signal.

Due to the aforementioned problems, planar coils are an inefficient choice for on-chip transformers and inductors in integrated circuit design.

SUMMARY OF THE INVENTION

From the foregoing, a need has arisen for an improved on-chip electrical coil which increases the inductance per unit length of the coil and reduces the parasitic capacitance associated with having every turn of the coil coupled to the substrate. In accordance with the present invention, a three dimensional micro-coil device and method of forming same is provided which substantially eliminates or reduces disadvantages or problems associated with conventional on-chip coils.

According to one embodiment of the present invention, there is provided a three-dimensional micro-coil that comprises two parallel layers of metal strips connected on their ends so as to make a coil produced from the metal strips. This design leaves one side of the four-sided coil in contact with the substrate material.

The present invention provides various technical advantages over conventional integrated circuit coil designs. One important technical advantage of the present invention inheres in the fact that thicker conductors can be used resulting in lower losses of signal. Another important technical advantage is the capability of having higher inductance per unit length because of the added mutual inductance. Another technical advantage is that having most of the coil above, and not in contact with, the substrate results in significantly lower inter-electrode capacitance. In addition, there is much lower signal loss due to the fact that magnetic fields are now perpendicular to the substrate. Other examples may be readily ascertainable by those skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numbers indicate like features, and in which.

DETAILED DESCRIPTION OF THE DRAWINGS

Figure 1:
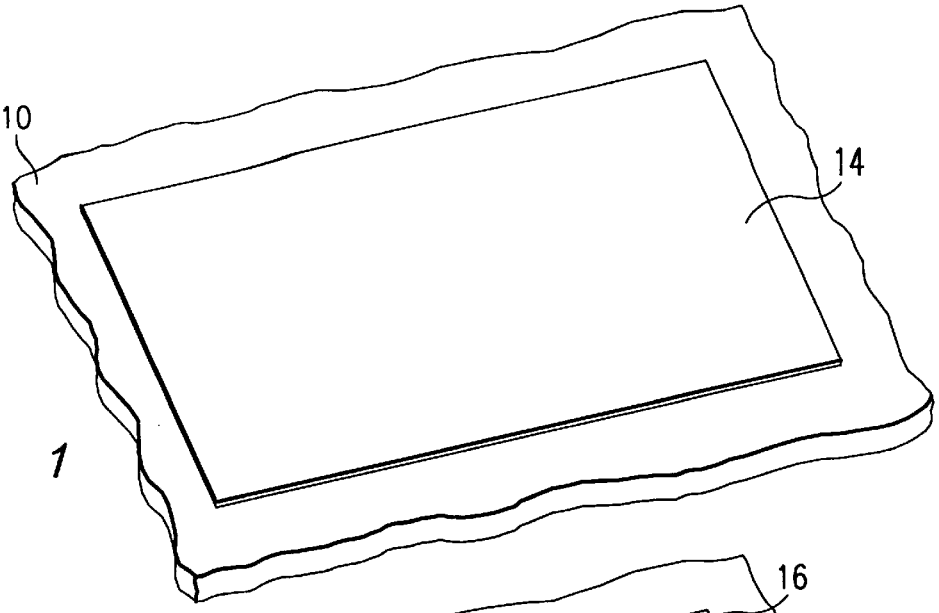
FIG. 1 illustrates a first layer of metal deposited on a portion of an integrated circuit substrate which will eventually contain a three-dimensional micro-coil.

Referring to FIG. 1, a semiconductor substrate 10 on which an integrated circuit may be formed is illustrated. Any suitable substrate material may be used. The substrate 10 is the surface on which the device of the present invention will be formed. A first metal layer 14 is deposited on substrate 10 in the area that will contain the micro-coil. The metal of first metal layer 14 may consist of any suitable metal of appropriate conductivity characteristics.

Figure 2:
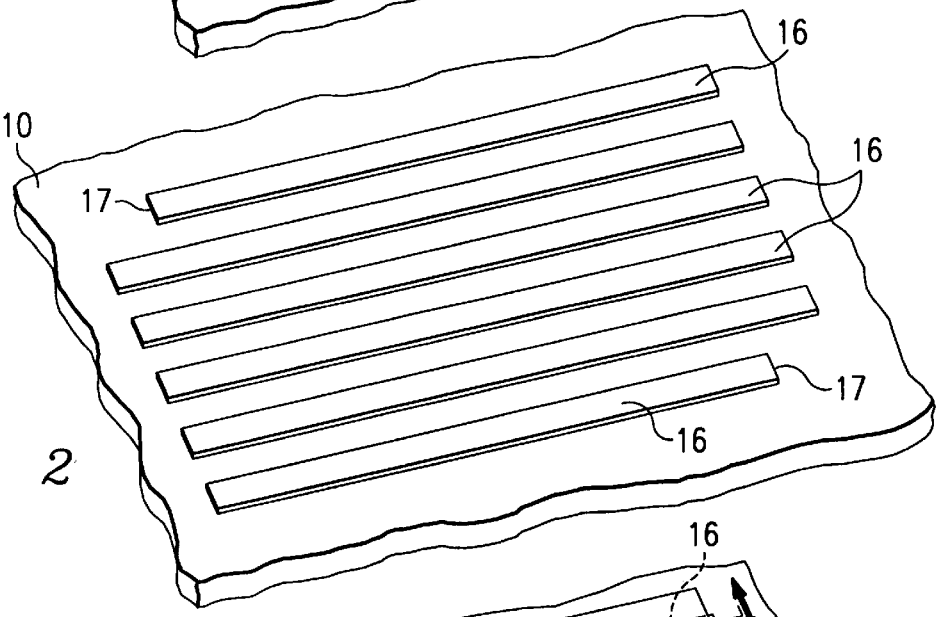
FIG. 2 illustrates the first metal layer etched and partitioned into metal strips.

Referring to FIG. 2, first metal layer 14 is partitioned into a first plurality of metal strips 16 by exposing first metal layer 14 to an etching process. The etching process may be performed by any of various conventional etching processes including plasma (dry) etching, wet etching, ablation etching, or any other suitable technique depending on the type of metal deposited in first metal layer 14. Opposite ends 17 of the outer metal strips 16 may be shortened to facilitate formation of the micro-coil. However, any suitable method may be used in the process of forming the three-dimensional micro-coil. Shortening the outer metal strips 16 will cause the shortened ends 17 of the outer metal strips 16 to be the terminal ends of the micro-coil.

Figure 3:
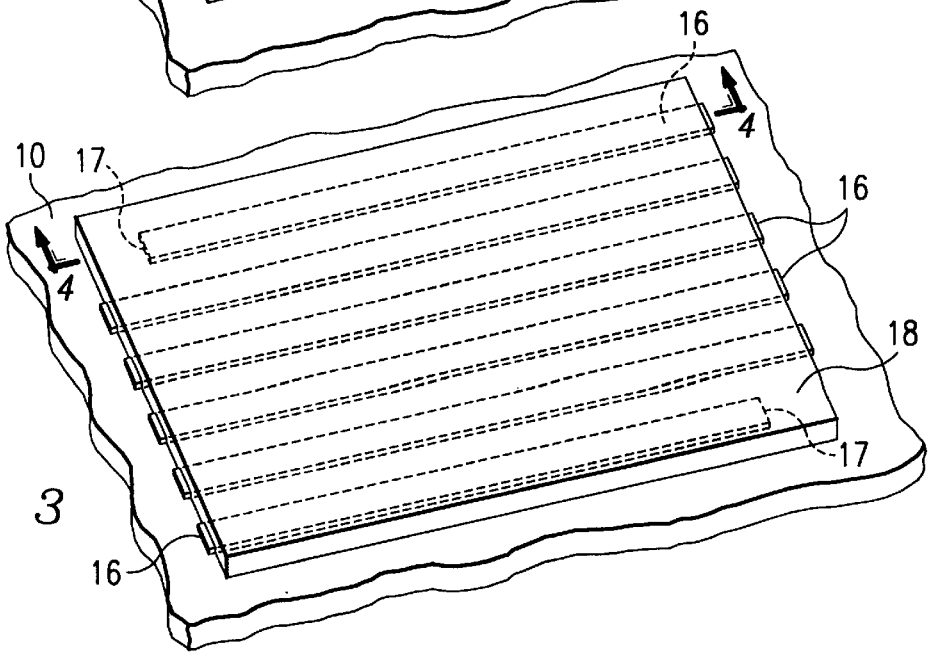
FIG. 3 illustrates deposition of a sacrificial layer.

Referring to FIG. 3, a sacrificial layer 18 is deposited on first plurality of metal strips 16 leaving both ends of each metal strip 16 exposed except that the shortened outer metal strips have their shortened ends 17 covered by the sacrificial layer to facilitate the formation of the micro-coil. It is important to note that an alternate method of formation of the micro-coil which does not require the shortening of the outer metal strips may be used. Sacrificial layer 18 may comprise any material which can easily be removed from the surface of both substrate 10 and the metal used to form first metal layer 14. The thickness of sacrificial layer 18 is constrained by device specifications and may be on the order of several microns to several millimeters.

Figure 4:
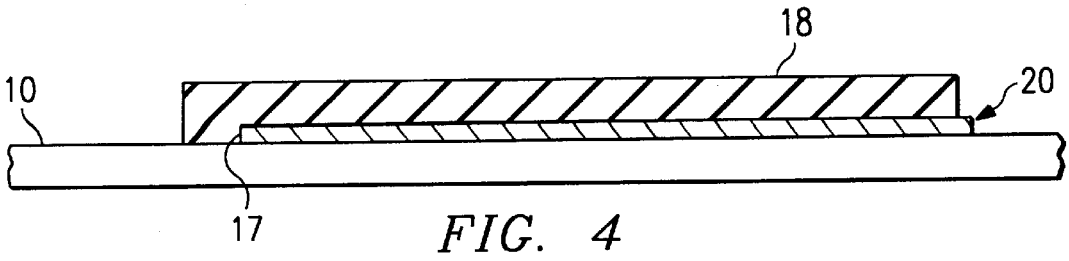
FIG. 4 is a side view of the three-dimensional micro-coil showing the first metal layer with the sacrificial layer deposited on top.

Referring to FIG. 4, a side view of the structure of FIG. 3 is illustrated. Substrate 10 forms the surface on which the device of the present invention is formed. Lower electrode 20 is one of the outer metal strips 16 and is deposited on substrate 10. Lower electrode 20 as shown has one of the terminal ends 17 of the three-dimensional micro-coil which is the subject of the present invention. Therefore, terminal end 17 of lower electrode 20 is covered by sacrificial layer 18 so as to ensure that it does not make contact with other metal layers of the three-dimensional micro-coil. It is important to note that when sacrificial layer 18 is deposited onto first plurality of metal strips 16, it may have square edges which may inhibit the proper depositing of the second metal layer which will be discussed with reference to FIG. 6. Therefore, the edges of sacrificial layer 18 should be rounded in order to promote proper depositing of the second metal layer. A reflow process is preferably used to achieve the rounded edges of sacrificial layer 18. However, additional etching or ablation steps may be used to reshape sacrificial layer 18 to achieve rounded edges.

Figure 5:
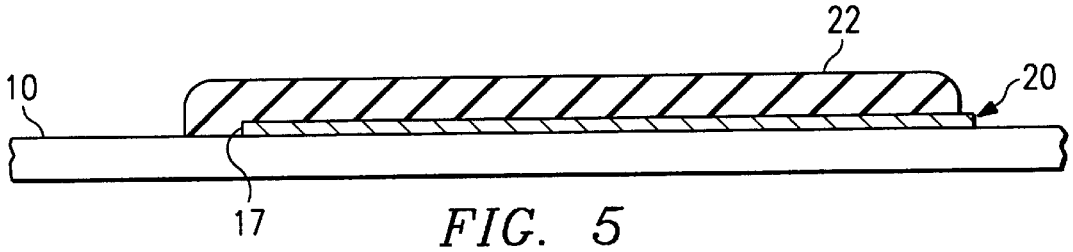
FIG. 5 is a side view of the three-dimensional micro-coil after the sacrificial layer has been reflowed to round its edges.

Referring to FIG. 5, a side view of the structure of FIG. 4 is shown after sacrificial layer 18 has been reflowed. Sacrificial layer 18 may be reflowed by any suitable process which may include heating sacrificial layer 18 to a level which results in reflowing of the layer and rounding of the edges. A reflowed sacrificial layer 22 is shown with rounded edges which promote the proper depositing of the second metal layer.

Figure 6:
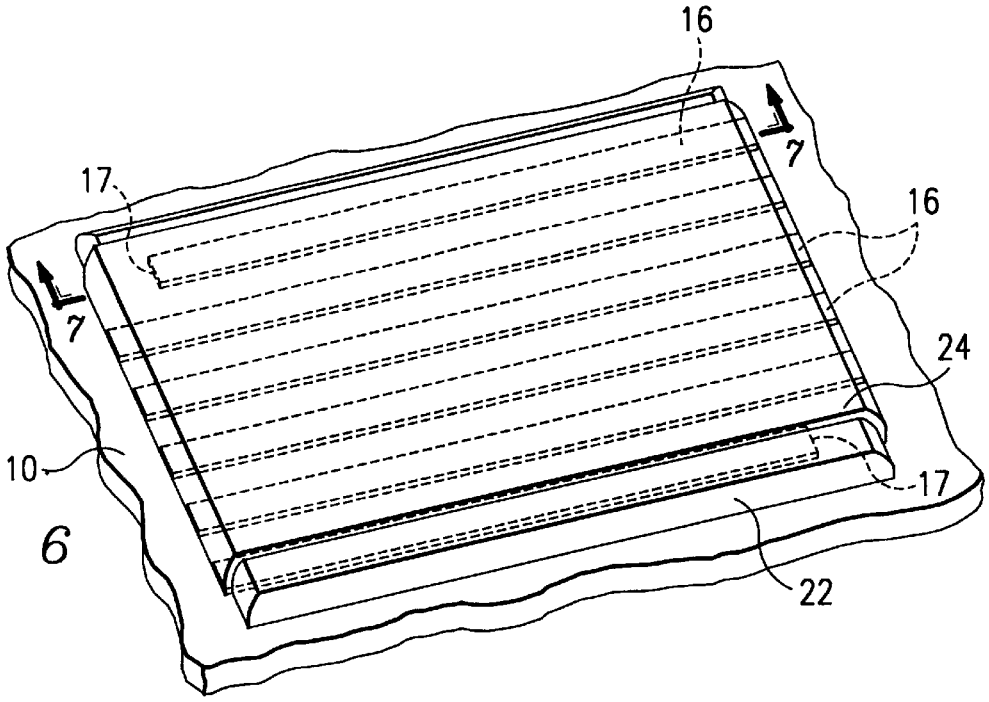
FIG. 6 illustrates a second metal layer deposited on top of the sacrificial layer.

Referring to FIG. 6, a second metal layer 24 is deposited over reflowed sacrificial layer 22 completely covering reflowed sacrificial layer 22. FIG. 6 illustrates a portion of second metal layer 24 after it is deposited over reflowed sacrificial layer 22. A portion of second metal layer 24 is shown so that reflowed sacrificial layer 22 can still be seen. An etching, or similar process, should be used to form second metal layer 24 appropriately. Second metal layer 24 should cover reflowed sacrificial layer 22 such that the exposed ends of first plurality of metal strips 16 are in contact with second metal layer 24.

Figure 7:
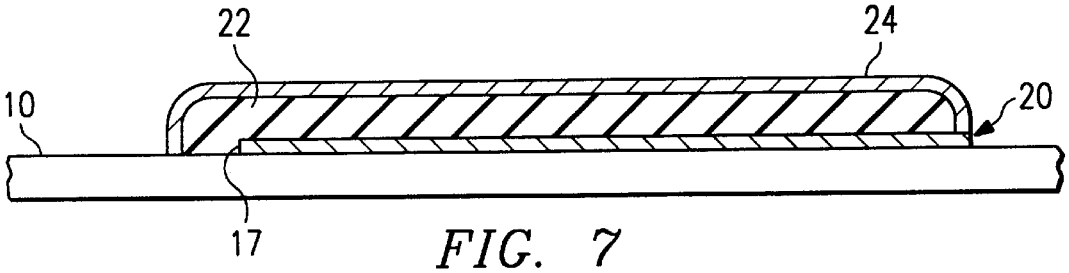
FIG. 7 is a side view of the three-dimensional micro-coil showing the two metal layers separated by the sacrificial layer.

Referring to FIG. 7, a side view of the structure of FIG. 6 is illustrated. Substrate 10 forms the base on which the present structure is formed. Second metal layer 24 completely covers reflowed sacrificial layer 22 so that second metal layer 24 comes in direct contact with the exposed end of lower electrode 20. As in FIG. 5, lower electrode 20 represents one of the terminal electrodes of the three-dimensional micro-coil. Therefore, second metal layer 24 only comes in contact with one end of lower electrode 20. It is important to note that second metal layer 24 comes in contact with the exposed end of lower electrode 20 and all exposed ends of first plurality of metal strips 16. Second metal layer 24 is usually composed of the same metal as first metal layer 14. However, any suitable metal may be used.

Figure 8:
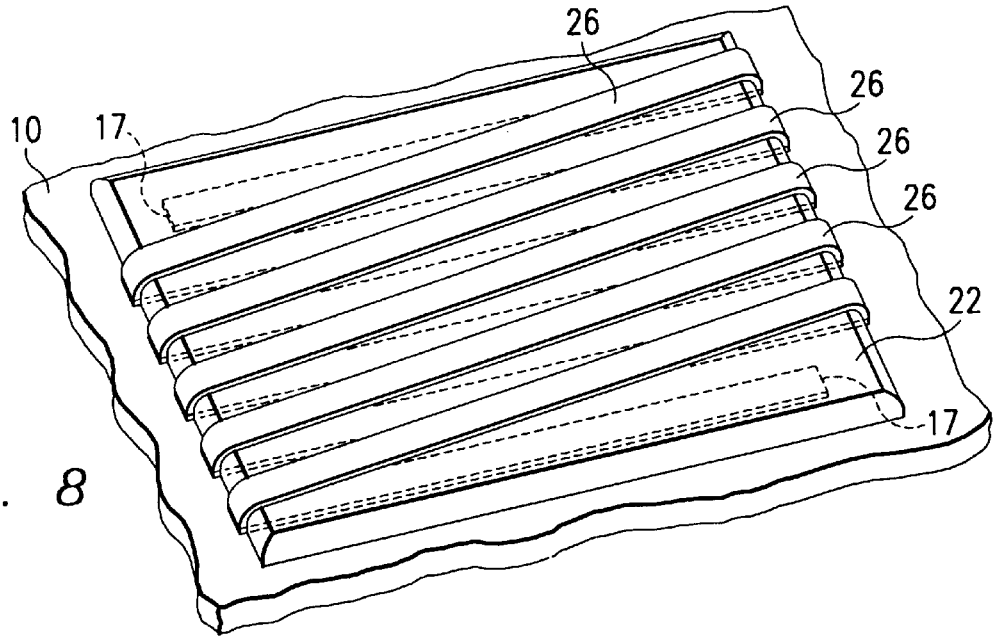
FIG. 8 illustrates the second metal layer etched and partitioned into metal strips.

Referring to FIG. 8, second metal layer 24 is partitioned into a second plurality of metal strips 26 by exposing second metal layer 24 to an etching process. As discussed above, the etching process may comprise plasma (dry) etching, wet etching, ablation etching, or any other suitable process to remove specific portions of second metal layer 24. Upon completion of the etching process, second plurality of metal strips 26 contacts first plurality of metal strips 16 in such a way as to form a continuous coil. This continuous coil is formed by connecting the end of one metal strip 16 formed from first metal layer 14 with the opposite end of an adjacent metal strip 16 in first plurality of metal strips 16 with a metal strip 26 formed in second metal layer 24. The continuous coil formed by this process forms the windings of a three-dimensional micro-coil device. This connection process is continued until only the terminal ends of the coil are not connected to another metal strip. It is important to note that although terminal ends 17 represent the ends of the three-dimensional micro-coil, appropriate connections to other on-chip structures or off-chip structures are provided during the fabrication process.

After second metal layer 24 has been etched into a second plurality of metal strips 26 such that a continuous coil of metal strip is formed, reflowed sacrificial layer 22 is removed. The removal of reflowed sacrificial layer 22 may be accomplished by any of various conventional techniques which may include exposing the structure to plasma (dry) etching, wet etching, a sublimation technique, or any suitable process to remove the material comprising reflowed sacrificial layer 22. After reflowed sacrificial layer 22 is removed, a three-dimensional micro-coil 28 exists on the surface of substrate 10.

Figure 9:
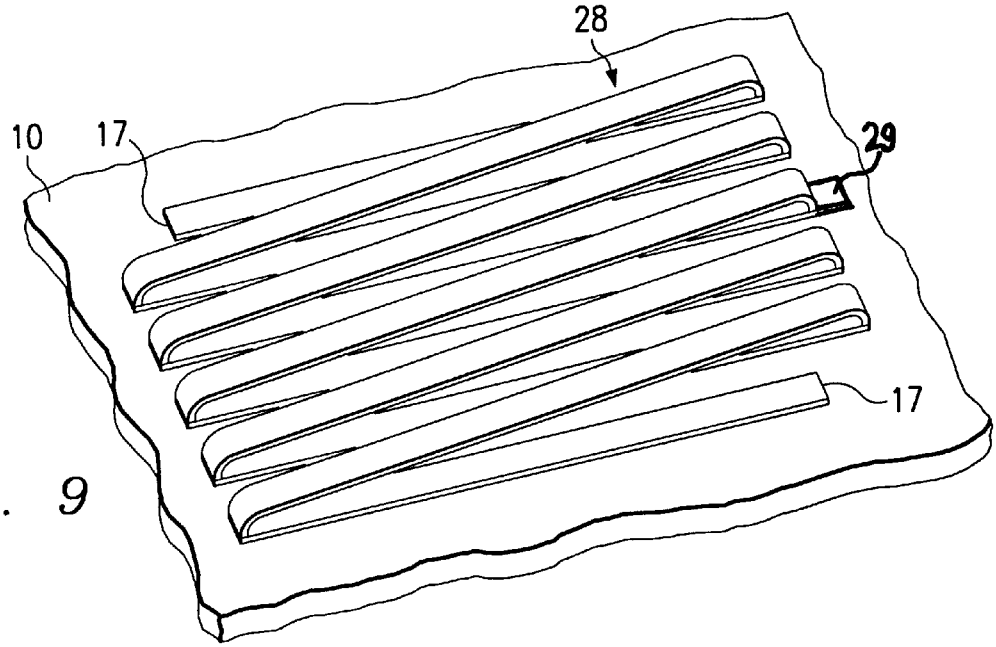
FIG. 9 illustrates the final three-dimensional micro-coil after the sacrificial layer has been removed.

Referring to FIG. 9, a three-dimensional micro-coil 28 is shown on substrate 10. Until the advancement of the present invention, on-chip coils have been planar, or two dimensional. This made on-chip coils impractical due to the inordinate amount of space which must be devoted to planar on-chip coils. Furthermore, the electrical characteristics of planar coils are not optimal. Three-dimensional micro-coil 28 results in the ability to use thicker conductors and realize higher inductance per unit length because of the added mutual inductance of the three-dimensional micro-coil. In addition, significantly lower inter-electrode capacitance exists since most of the metal strip comprising three-dimensional micro-coil 28 is not in direct contact with substrate 10. Moreover, the present invention results in much lower signal loss due to the fact that the magnetic fields are now perpendicular to the substrate.

Figure 10:
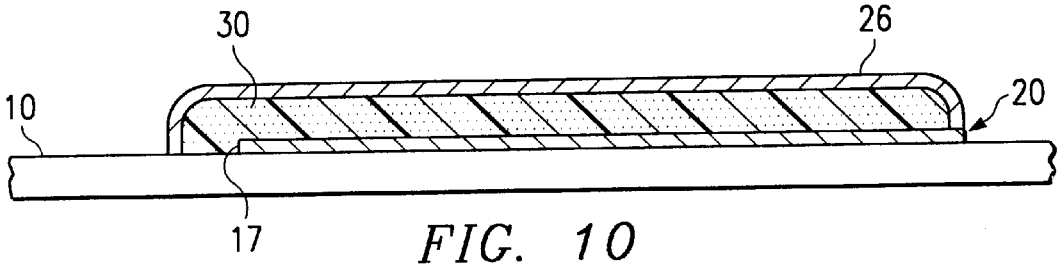
FIG. 10 is a side view of the three-dimensional micro-coil with a high permeability material separating the two layers of metal.

Referring to FIG. 10, a three-dimensional micro-coil 28 is illustrated having a high permeability layer 30. High permeability layer 30 occupies the same space as sacrificial layer 18 and is formed in the same manner as sacrificial layer 18. Utilizing a high permeability material for high permeability layer 30 allows the magnetic fields in the coil to be concentrated, and thus, significantly increase inductance. High permeability layer 30 is not removed from the three-dimensional micro-coil 28 at the conclusion of formation. Instead, it remains within the center of the coil. The high permeability material may be made of a material that includes zinc oxide or manganese oxide, but any suitable high permeability material will suffice.

Three-dimensional micro-coil 28 may be used to create an on-chip transformer. By forming two three-dimensional micro-coils in close proximity, a transformer will result. High permeability layer 30 may be formed so that it couples the two three-dimensional micro-coils into a transformer. The use of high permeability layer 30 would enhance the performance of the transformer.

Three-dimensional micro-coil 28 may be implemented as an inductor device within a small circuit design. Three-dimensional micro-coil 28 may also be designed as two separate coil elements with variable windings in order to create a transformer device. Another important advantage of the ability to construct three-dimensional micro-coil 28 on substrate 10 is the ability to create auto transformers on the integrated circuit. By tapping a winding of three-dimensional micro-coil 28 on a tap 29 as shown in FIG. 9, an auto transformer may be formed which will allow impedance transformation. Impedance transformation is a valuable tool in filter design and is not possible with planar coils.

Three-dimensional micro-coil 28 may be implemented in a variety of transformer configurations. Two three-dimensional micro-coils 28 may be implemented in an unbalanced-to-unbalanced (unun) or balanced-to-unbalanced (balun) transformer design. Any suitable type of transformer design may be used including the Ruthroff transformer design or the Guanella transformer design. The transformers may be in any suitable configuration including a rod/core configuration or a toroid configuration. The material used to form three-dimensional micro-coils 28 into a transformer configuration may consist of any suitable material including a ferrite material. Ferrite tends to enhance the performance of transformers, but it may also limit the frequency response. Therefore, the material used to form three-dimensional micro-coils 28 may be chosen based on the performance requirements of the transformer.

According to the teachings of the present invention, an integrated circuit is provided that utilizes a three-dimensional micro-coil. The advantages of three-dimensional micro-coils include lower electrical signal losses since thicker conductors can be used and the magnetic fields are perpendicular to the substrate, higher inductance per unit length because of increased mutual inductance as compared to planar on-chip coils, and significantly lower inter-electrode capacitance because most of the coil is not in direct contact with the substrate.

Although the present invention has been described with relation to forming three-dimensional micro-coils as part of an integrated circuit, the teachings of the present invention may also be used to form three-dimensional micro-coils on other suitable substrate materials such as for use in personal computer boards and hybrid devices.

Thus, it is apparent that there has been provided in accordance with the present invention, a three-dimensional micro-coil device and method of fabrication that satisfy the advantages set forth above. Although the present invention and its advantages have been described in detail, it should be understood that various changes, substitutions, and alterations readily apparent to those skilled in the art may be made herein without departing from the spirit and the scope of the present invention as defined by the following claims.

What is claimed is:

1. A three-dimensional micro-coil, comprising:

a substrate layer;

a first plurality of metal strips formed on and in contact with one surface of the substrate, the first plurality of metal strips arranged in a substantially parallel configuration;

a second plurality of metal strips, each metal strip of the second plurality having a substantially flat upper section and first and second side sections joined at a substantially 90° angle to the flat upper sections, and first and second rounded intermediate sections joining the first and second side sections to the flat upper section; and each of the first and second side sections connected directly to the ends of adjacent metal strips of the first plurality to form a configuration wherein the first plurality of metal strips has a surface thereof exposed to a surface of the metal strips of the second plurality.

2. The three-dimensional micro-coil of claim 1, wherein the connected first and second plurality of metal strips provide a first and second end of the three-dimensional micro-coil, the three-dimensional micro-coil including a tap on one of the windings formed by the connected first and second plurality of metal strips such that the tap and the first and second ends provide connections for an autotransformer configuration.

3. The three-dimensional micro-coil of claim 1, wherein the connected first and second plurality of metal strips form an inductor.

4. The three-dimensional micro-coil of claim 1, wherein the first and second plurality of metal strips are connected to form a first and second three-dimensional micro-coil, the first and second three-dimensional micro-coil providing a transformer configuration.

5. The three-dimensional micro-coil of claim 1, wherein the first and second plurality of metal strips are connected to form a first three-dimensional micro-coil and a second three-dimensional micro-coil, the first and second three-dimensional micro-coils providing an unbalanced-to-unbalanced transformer configuration.

6. The three-dimensional micro-coil of claim 1, wherein the first and second plurality of metal strips are connected to form a first three-dimensional micro-coil and a second three-dimensional micro-coil, the first and second three-dimensional micro-coils providing a balanced-to-unbalanced transformer configuration.

* * * * *